United States Patent [19]

Eitoku et al.

[11] Patent Number: 4,884,052

[45] Date of Patent: Nov. 28, 1989

[54] CONTACT STRUCTURE FOR SLIDER POSITION SENSOR

[75] Inventors: Kenji Eitoku; Mamoru Tateishi; Kenji Hayashi, all of Obu, Japan

[73] Assignee: Aisan Kogyo Kabushiki, Obu, Japan

[21] Appl. No.: 200,517

[22] Filed: May 26, 1988

[30] Foreign Application Priority Data

May 29, 1987 [JP] Japan ..... 62-85389[U]
May 29, 1987 [JP] Japan ..... 62-85390[U]

[51] Int. Cl.[4] ..... H01C 1/012

[52] U.S. Cl. ..... 338/202; 338/118; 338/123; 338/124; 338/174

[58] Field of Search ..... 338/202, 118, 123, 124, 338/174, ; 439/296

[56] References Cited

U.S. PATENT DOCUMENTS 3,119,089 1/1964 Murry ..... 338/202
3,617,978 11/1971 Gerstmeier ..... 338/202

FOREIGN PATENT DOCUMENTS 59-39905 3/1984 Japan .
60-211802 10/1985 Japan .

*Primary Examiner*—B. A. Reynolds
*Assistant Examiner*—M. M. Lateef
*Attorney, Agent, or Firm*—Dennison, Meserole, Pollack & Scheiner

[57] ABSTRACT

A sliding contact includes a sliding contact piece having a contact segment and fixed to a snap member extending perpendicularly to the contact segment. The snap member has at least two snap portions formed in alignment perpendicular to the contact segments including one adjacent the contact segments which is adapted to be concentrically fitted onto a mounting projection of a slider and another apart from the contact segments which is adapted to keep the angle of the contact segments to the slider. Also, there is a connecting contact with at least two holding arms for nipping therebetween a substrate on both sides thereof, at least one of the holding arms having a projection to be inserted in a hole or recess preliminarily formed in the substrate. After the projection is received in the hole or recess, it is fixed by a conductive anchoring material such as solder, so that the connecting contact may be fixedly attached to the substrate.

6 Claims, 5 Drawing Sheets

CONTACT STRUCTURE FOR SLIDER POSITION SENSOR

BACKGROUND OF THE INVENTION

The present invention relates to a device in which a slider having a sliding contact is slidingly movable on an electrode pattern, and especially to a contact structure in such a device. More specifically, it relates to an improved contact structure for accurately detecting the position of the slider.

FIGS. 1 and 2 show an example of such a device to which the contact structure according to the present invention can be applied. The device shown in fact is a throttle valve sensor which is adapted to detect the opening degree of a throttle valve employed for controlling an intake air to be admitted into an internal combustion engine.

The device includes a power terminal 2 to be connected to a power supply, so that current is supplied through the terminal 2 to an electrode pattern 28 printed on an insulating substrate 26. The electrode pattern 28 is printed with a conductive material and is connected to another electrode pattern 22 which is printed with a material having a suitable resistance. The electrode pattern 22 is connected to a ground terminal 8. There is provided inside of the electrode pattern 22 a further electrode pattern 20 which is printed with a conductive material and connected to a signal terminal 6.

A sliding contact piece 24 is fixed to a slider (not shown) which is rotated around the center of the electrode patterns 22 and 20 in response to opening and closing of the throttle valve (not shown).

In such a throttle valve sensor as described above, output of the signal terminal 6 is varied in response to the opening degree of the throttle valve, and thus the opening degree of the throttle valve is detected according to the output of the signal terminal 6.

According to this type of sensor, accurate detection of the opening degree of the throttle valve requires stable contact between the power terminal 2 and the electrode pattern 28, stable contact pressure to be applied by a sliding contact piece 24 to the electrode patterns 20 and 22, accurate relative arrangement of the slider and the sliding contact piece 24, and stable contact between the electrode pattern 22 and the ground terminal 8 and between the electrode pattern 20 and the signal terminal 6.

FIG. 10 shows an example of a prior art sliding contact piece. The sliding contact piece 204 is composed of a rectangular base plate 206 and a pair of contact segments 200 and 212 extending from a side 202 of the base plate 206 perpendicularly thereto. The sliding contact piece 204 has a mounting hole 208 formed around the center of the base plate 206 and flat springs 210 provided on the side opposite to the side 202.

FIG. 11 shows a sectional view taken along the line XI—XI in FIG. 10, illustrating the sliding contact piece 204 in FIG. 10 fixed onto a slider 224. The slider 224 includes a face 222 on which the base plate 206 of the sliding contact piece 204 is mounted. The face 222 is formed with an edge portion 220 on the left as viewed in FIG. 11, another edge portion 214 on the right and a projection 216 around the center thereof. When the sliding contact piece 204 is attached to the slider 224 with the mounting hole 208 fitted onto the projection 216, the flat springs 210 are brought into abutment against the edge portion 220 to be deflected, and the side portion 202 is forced against the edge portion 214 to be fixed thereby. Thus, the sliding contact piece 204 is positionally restricted in relation to the slider 224 in the right-to-left direction as viewed in FIG. 11. Keeping the assembly in this condition, a snap member 218 is press-fitted onto the projection 216 from the upside, so that the sliding contact piece 204 is fixed in relation to the slider 224 and positionally restricted in relation thereto in the vertical direction. The slider 224 has a face 226 extending from the face 222, and the meeting line therebetween is a start line of deflection of the contact segments 200 and 212. With this arrangement, the sliding contact piece 204 may be positioned in relation to the slider 224 and be brought into contact with a conductor under a predetermined pressure. The above arrangement is disclosed in detail in Japanese Utility Model Laid-Open Publication No. 59-39905.

Such an arrangement, however, still suffers from the following problems. First of all, the sliding contact piece 204 must be mounted onto the slider 224 with the flat springs deflected, causing a difficult mounting operation. Secondly, the side portion 202 of the sliding contact piece 204 bites into the edge portion 214 to cause inaccurate positioning, especially when the sliding contact piece 204 is formed of a thin plate having a thickness of about 0.1 mm. The third problem is that the base plate 206 of the sliding contact piece 204 will not come into tight contact with the mounting face 222 of the slider 224 but generate undulation on the mounting face 222. This problem is conspicuous, especially when it is in an environment subject to substantial change in temperature and heavy vibration such as in an engine room of an automobile.

FIGS. 12 to 14 show a prior art connecting contact for connecting the electrode patterns 28, 22, 20, 18, etc. with the terminals 2, 8, 6, etc. in FIG. 1 and mounting thereof to the substrate.

As shown in FIG. 12, a connecting contact 232 is a substantially cruciform member having an upper end portion 228 for anchoring and a through hole 230 formed substantially at the center of the end portion 228. FIGS. 13 and 14 show mounting of the connecting contact 232 to the substrate 238 in two sections perpendicular to each other. An electrode pattern 240 is printed on the upper surface of the substrate 238, and the substrate 238 and the electrode 240 have a common square hole 236 through which the end portion 228 of the connecting contact 232 is inserted. The connecting contact 232 inserted into the square hole 236 from the underside is joined to the electrode pattern 240 by solder 234. Preferably, the through hole 230 is filled with the solder 234, as shown in FIG. 14. Thus constructed, the connecting contact 232 is fixed to the substrate 238 and electrical contact is assured between the connecting contact 232 and the electrode pattern 240. This is disclosed in Japanese Patent Laid-Open Publication No. 60-211802.

Such a connecting contact structure, however, suffers from the following problems. First, soldering of the connecting contact 232 to the electrode pattern 240 must be performed, preventing the connecting contact 232 from falling down out of the substrate 238, so that soldering operation is troublesome. Secondly, the essential element for preventing the connecting contact 232 from falling out is the solder filling the through hole 230, but as it cannot be assured that the through hole 230 is filled with the solder, this structure lacks reliability.

SUMMARY OF THE INVENTION

It is an object of the present invention to provide a structure which can accurately position and fix a sliding contact in relation to a slider.

It is another object of the present invention to provide a structure which can fix a sliding contact to a slider in such a manner as to keep the contact pressure of the sliding contact constant.

It is a further object of the present invention to provide a connecting contact structure which assures stable contact between an electrode pattern and an external connecting terminal.

It is a still further object of the present invention to provide a connecting contact structure which permits ready mounting.

The sliding contact according to the present invention includes a sliding contact piece having a contact segment and fixed to a snap member extending perpendicularly to the contact segment. The snap member has at least two snap portions formed in alignment perpendicular to the contact segments including one to be positioned adjacent the contact segments which is adapted to be concentrically fitted onto a mounting projection of a slider and another to be positioned apart from the contact segments which is adapted to keep the angle of the contact segments to the slider.

The connecting contact according to the present invention comprises at least two holding arms for nipping therebetween a substrate on both sides thereof, at least one of the holding arms having a projection to be inserted in a hole or recess preliminarily formed in the substrate. After the projection is received in the hole or recess, it is fixed by a conductive anchoring material such as solder, so that the connecting contact may be fixedly attached to the substrate.

The problems associated with the prior art contact structure may be completely eliminated by using the above mentioned sliding contact or connecting contact structure of the present invention.

The invention will be more fully understood from the following detailed description and appended claims when taken with the drawings.

DETAILED DESCRIPTION OF THE PREFERRED EMBODIMENTS

Figure 3:
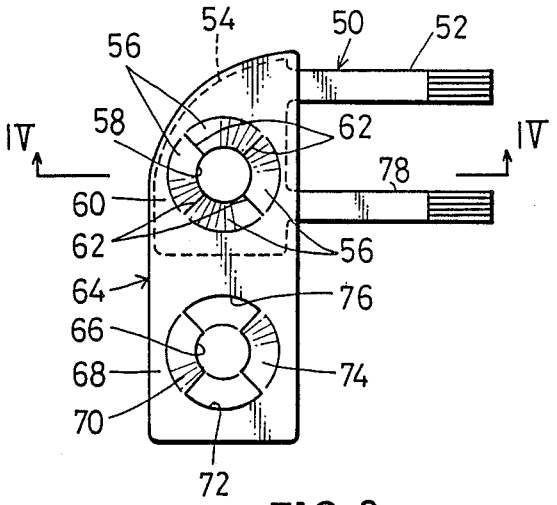
FIG. 3 is a plan view of a combination of a sliding contact piece and a snap member.

In FIG. 3 which is a plan view of a sliding contact piece 50 and a snap member 64, the sliding contact piece 50 is formed of a thin metal plate having a thickness of about 0.1 mm. The sliding contact piece 50 is composed of a pair of contact segments 52 and 78 extending in substantially parallel relationship to each other and a base plate 54 having a through hole around the center thereof. The base plate 54 is substantially fully covered with the snap member 64, both being fixed to each other by resistance welding, for example. The snap member 64 is thicker than the sliding contact piece 50 to prevent deflection.

The snap member 64 is elongated in the direction perpendicular to the contact segments 52 and 78 and has two snap portions 60 and 68 formed in alignment in the longitudinal direction.

The first snap portion 60 is composed of a mounting hole 58 formed concentrically with and having the same diameter as the through hole of the base plate 54 of the sliding contact piece 50 and slits 62 extending in four directions from the mounting hole 58. The mounting hole 58 is slightly smaller in diameter than a projection of a slider which will be mentioned hereinafter, so that when the mounting hole 58 is fitted onto the projection, four snap segments 56 defined around the periphery of the mounting hole 58 are resiliently deformed upwardly, as shown in FIG. 4, to firmly attach the snap member 64 to the slider and to position the sliding contact piece 50 with the mounting hole 58 concentrically disposed in relation to the projection.

The second snap portion 68 is composed of a mounting hole 66 and slits extending therefrom in four directions, but both of the longitudinal snap segments are cut off to define spaces 72 and 76. That is, there are provided snap segments 70 and 74 only on the right and left sides of the mounting hole 66 as viewed in FIG. 3. This allows ready engagement between the snap portions and the projections, even if there is any slight error of distance between the two mounting projections of the slider or between the first snap portion 60 and the second snap portion 68. Also, even in such a case, the angle of the contact segments 52 and 78 to the slider may be kept constant.

Figure 4:
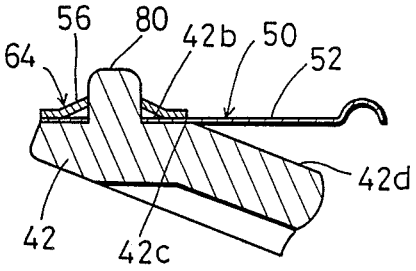
FIG. 4 is a sectional view taken along the line IV—IV in FIG. 3 in which the sliding contact piece and the snap member are fixed to the slider.

FIG. 4 shows in section the sliding contact piece 50 and the snap member 64 fixed to a slider 42. The slider 42 has projections 80 fitted in the snap portions 60 and 68 so as to fix the sliding contact piece 50 in an accurate positional relation to the slider 42.

The slider 42 has a mounting face **42*b* for the sliding contact piece 50 and an inclined face 42*d* extending therefrom, the meeting line between the two faces 42*b* and 42*d* being a start line of deflection of the contact segments 52 and 78. As the sliding contact piece 50 is accurately positioned in relation to the slider 42, constant contact pressure may be applied by the contact segments 52 and 78**.

Figure 5:
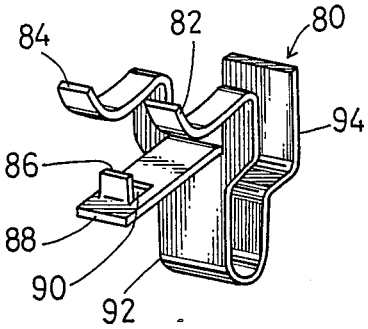
FIG. 5 is a perspective view of a connecting contact according to the present invention.
Figure 8:
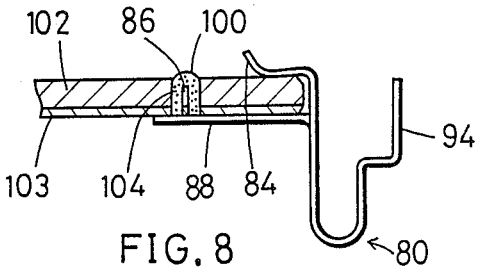
FIG. 8 is a sectional view of the connecting contact in FIG. 5 fixed to a substrate.

FIG. 5 is a perspective view of a connecting contact 80 according to the present invention, and FIG. 8 shows the connecting contact 80 fixed to a substrate 102.

The connecting contact 80 has holding arms 82, 84 and 88 for nipping opposite surfaces of the substrate 102. Each of the upper holding arms 82 and 84 has an upwardly curved end so as to facilitate fitting of the connecting contact 80 onto the substrate 102 on the opposite surfaces thereof. The lower holding arm 88 has adjacent the free end thereof a projection 86 formed by upwardly bending a portion of the end.

The connecting contact 80 has a U-shaped portion 92 terminating in an end 94 to which an external connecting terminal may be fixedly connected. The connecting contact 80 is formed of a metal plate, so that it may be manufactured at a low cost.

As shown in FIG. 8, an electrode pattern 103 is printed on the surface of the insulating substrate 102, and the electrode pattern 103 and the substrate 102 have a common through hole 100 for mounting the connecting contact 80. The connecting contact 80 is attached to the substrate 102, with the electrode pattern 103 inserted in the mounting hole 100. Thus, the connecting contact 80 is positioned on the substrate 102. Then, the mounting hole 100 is filled with solder 104 so as to fix the connecting contact 80 to the substrate 102 and to form stable electrical connection between the connecting contact 80 and the electrode pattern 103.

Figure 1:
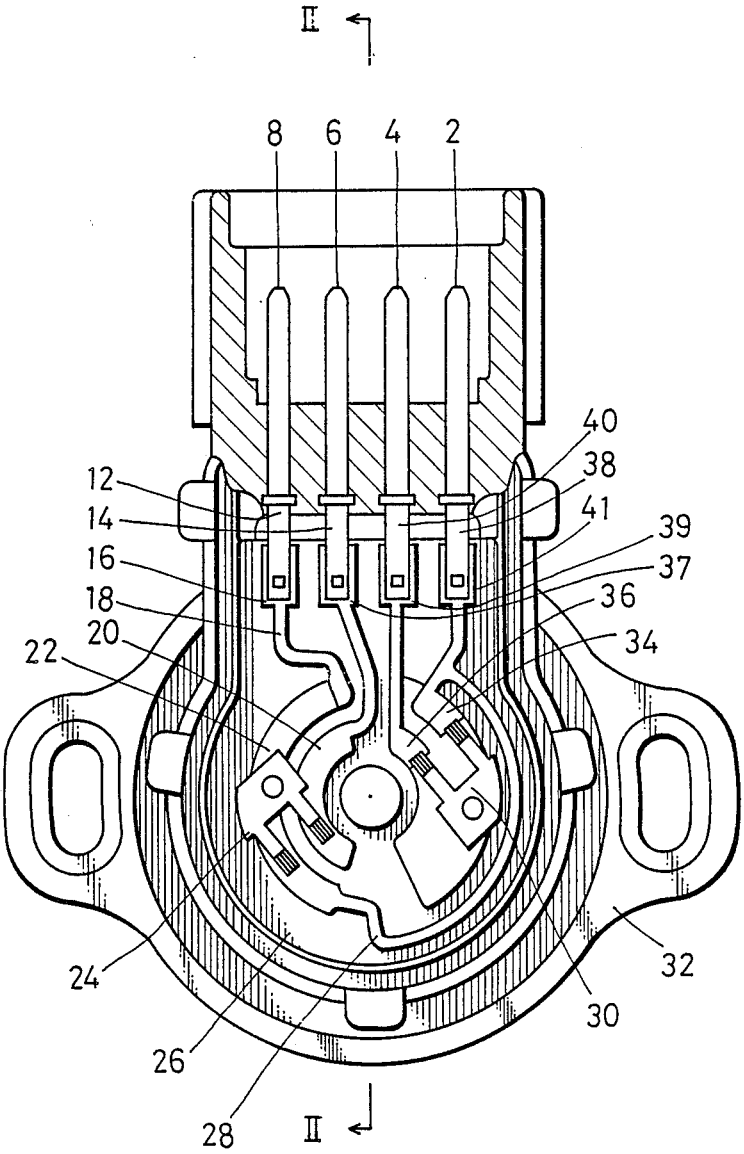
FIG. 1 is a plan view of a throttle valve sensor to which a contact structure according to the present invention is applied, in which the upper parts including a slider are eliminated for better understanding.
Figure 2:
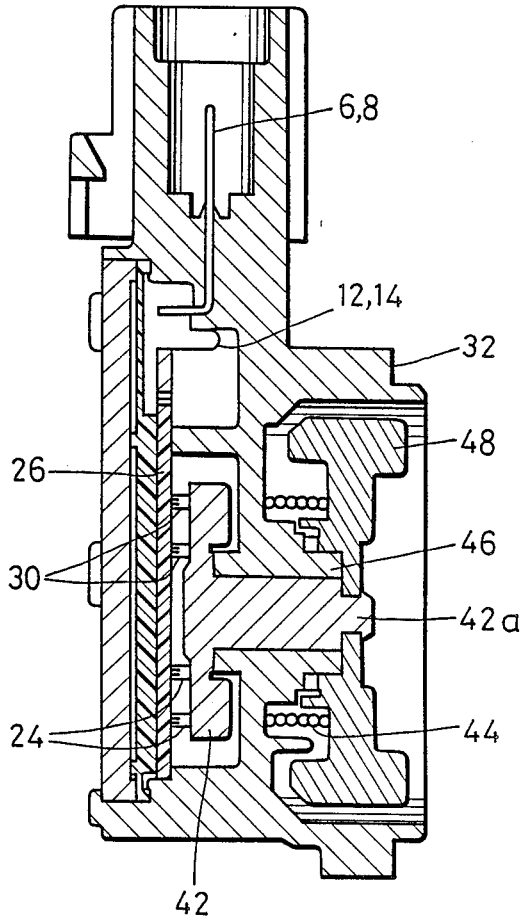
FIG. 2 is a selected view taken along the line II—II in FIG. 1 in which the slider is shown.

FIGS. 1 and 2 show a throttle valve sensor to which the contact structure according to the present invention is applied.

Electrode patterns 28, 34, 36, 20, 22 and 18 are printed on a ceramic substrate 26. Only the electrode pattern 22 is printed with a material having a suitable resistance and the others are all printed with a conductive material. The electrode patterns 18, 20, 36 and 34 are connected at an end of the substrate 26 to the electrode patterns 16, 37, 39 and 41 for connection to corresponding connecting contacts, respectively. Four connecting contacts 12, 14, 40 and 38 having the same construction as the connecting contact 80 shown in FIG. 5 are fixedly connected to these electrode patterns. In this case, they are attached, with the respective lower holding arms like the lower holding arm 88 in FIG. 5 in engagement with the electrode patterns 16, 37, 39 and 41. Terminals 2, 4, 6 and 8 for external connection are connected to the connecting contacts 38, 40, 14 and 12, respectively.

As shown in FIG. 2, the slider 42 is rotatably supported by a bearing 46 in a housing 32. The slider 42 has a shaft **42*a* to which a lever 48 is firmly secured outside of the housing 32. The lever 48 is rotated around the shaft 42*a* in response to opening and closing of a throttle valve (not shown). A coil spring 44 is interposed between the housing 32 and the lever 48** so as to urge the lever in a predetermined direction.

The ceramic substrate 26 is fixedly disposed within the housing 32 in opposed relationship to the slider 42. The slider 42 carries sliding contact pieces 30 and 24 as described with reference to FIGS. 3 and 4. In such an arrangement, the sliding contact pieces 30 and 24 are slidingly movable on the electrode patterns 34, 36 and 22, 20. In FIG. 1, the terminal 2 is a power terminal, the terminal 4 an idle signal terminal, the terminal 6 a throttle valve opening degree signal terminal, and the terminal 8 a ground terminal.

The throttle valve sensor in FIG. 1 shows an idling condition, in which the electrode patterns 34 and 36 are short-circuited by the sliding contact piece 30. When the opening degree of the throttle valve becomes larger than that during idling, electrical connection between the electrode patterns 34 and 36 is cut off, and thus, a change in output of the signal terminal 4 can be used to determine whether or not the engine is at idling. When the throttle valve is opened, the sliding contact piece 24 is rotated clockwise, and thus the resistance between the terminals 2 and 6 varies in response to the opening degree of the throttle valve. Consequently, a change in output of the signal terminal 6 may be detected to measure the opening degree of the throttle valve.

Figure 6:
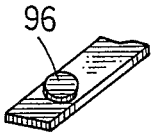
FIGS. 6 and 7 show various types of projections which may be formed on the connecting contact in FIG. 5.
Figure 7:
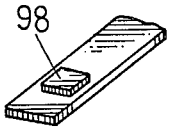
Figure 9:
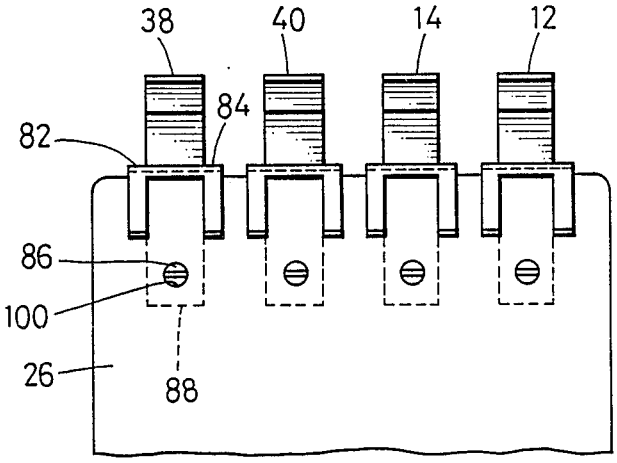
FIG. 9 is a plan view illustrating four connecting contacts in FIG. 5 fixed to the substrate.
Figure 10:
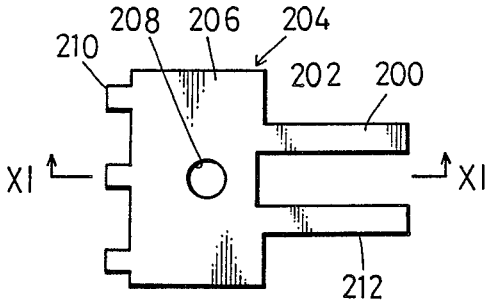
FIG. 10 PRIOR ART
FIG. 10 is a plan view of prior art sliding contact piece.
Figure 11:
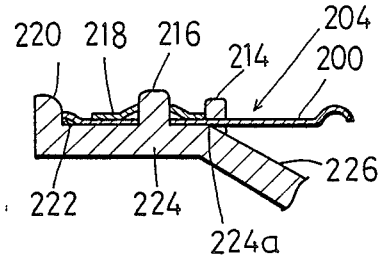
FIG. 11 PRIOR ART
FIG. 11 is a sectional view taken along the line XI—XI in FIG. 10 illustrating the sliding contact piece fixed to a slider.
Figure 12:
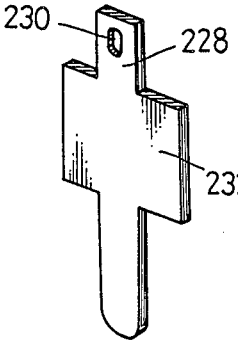
FIG. 12 PRIOR ART
FIG. 12 is a perspective view of a prior art connecting contact.
Figure 13:
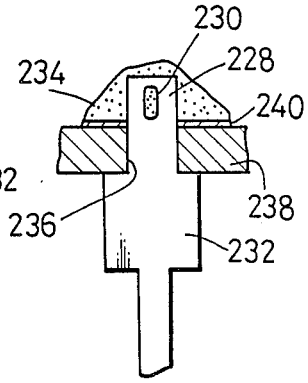
FIG. 13 PRIOR ART
FIGS. 13 and 14 show the connecting contact in FIG. 12 fixed to a substrate in sections perpendicular to each other.
Figure 14:
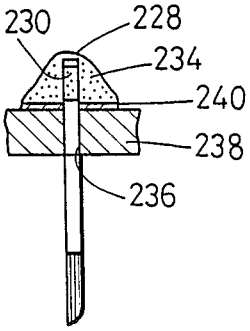
FIG. 14 PRIOR ART

FIG. 9 shows the connecting contacts 12, 14, 40 and 38 fixed to the substrate 26 as viewed from the side reverse to the one shown in FIG. 1, and the upper holding arms 82 and 84 as shown in FIG. 5 are illustrated. The projections 86 are inserted in the mounting holes 100 as shown in FIG. 8. The projection 86 is not limited to one shown in FIG. 5, and proper modifications such as a circular projection 96 in FIG. 6 and a square projection 98 in FIG. 7 may be employed.

Having thus described the preferred embodiments of the invention, it should be understood that numerous structural modifications and adaptations may be made without departing from the spirit of the invention.

What is claimed is:

1. A sliding contact slidingly moveable on an electrode in association with a sliding movement of a slider, comprising:

a sliding contact piece including an elongated contact segment slidingly contacting said electrode and a base plate formed at a base portion of said contact segment, said base plate having a mounting hole for engaging a first projection of said slider; and an elongated snap member for positioning and fixing said sliding contact piece with respect to said slider, said snap member mounted on said base plate of said sliding contact piece and extending in a direction substantially perpendicular to an extending direction of said contact segment, said second snap member formed with first and second snap portions arranged in spaced relationship to each other in the extending direction of said snap member, said first snap portion having a first mounting hole for engaging said first projection of said slider and a plurality of first snap segments formed around said first mounting hole, and said second snap portion having a second mounting hole for engaging a second projection of said slider and a pair of cutouts continuing from said second mounting hole at opposite positions in the extending direction of said snap member to form a pair of opposed second snap segments.

2. The sliding contact as defined in claim 1, wherein said contact segment of said sliding contact piece comprises a pair of contact segments parallel to each other.

3. A connecting contact to be electrically connected to an electrode pattern which is printed on a substrate, comprising;

holding arms for nipping opposite surfaces of said substrate; and a projection formed on at least one of said holding arms, said connecting contact being positioned by holding said substrate between said holding arms and inserting said projection into a mounting hole formed in said substrate.

4. The connecting contact as defined in claim 3, wherein said connecting contact is formed of a metal plate.

5. The connecting contact as defined in claim 4, wherein one end portion of said metal plate is cut into three portions, so that two of said three portions on opposite sides engage with one surface of said substrate and a central remaining portion of said three portions engages with the other surface of said substrate.

6. The connecting contact as defined in claim 4, wherein said projection is formed by bending.

* * * * *

UNITED STATES PATENT AND TRADEMARK OFFICE

CERTIFICATE OF CORRECTION

PATENT NO. : 4,884,052

DATED : November 28, 1989

INVENTOR(S) : Kenji Eitoku et al

It is certified that error appears in the above-identified patent and that said Letters Patent is hereby corrected as shown below:

Title page:

The name of the Assignee should read as follows:

Aisan Kogyo Kabushiki Kaisha

Signed and Sealed this

Thirtieth Day of April, 1991

*Attest:*

HARRY F. MANBECK, JR.

*Attesting Officer*

*Commissioner of Patents and Trademarks*